United States Patent [19]

Gustavsson

[11] Patent Number: 4,666,475

[45] Date of Patent: May 19, 1987

[54] DISCHARGE ELECTRODE

[75] Inventor: Curt Gustavsson, Växjö, Sweden

[73] Assignee: Fläkt AB, Nacka, Sweden

[21] Appl. No.: 817,609

[22] Filed: Jan. 10, 1986

[30] Foreign Application Priority Data

Jan. 28, 1985 [SE] Sweden ..... 8500389

[51] Int. Cl.[4] ..... B03C 3/41

[52] U.S. Cl. ..... 55/148; 55/152

[58] Field of Search ..... 55/148, 140, 150–152

[56] References Cited

U.S. PATENT DOCUMENTS 4,303,418 12/1981 Coe, Jr. ..... 55/152 X

FOREIGN PATENT DOCUMENTS 1575404 9/1980 United Kingdom ..... 55/152
2070979 9/1981 United Kingdom ..... 55/150
331819 4/1972 U.S.S.R. ..... 55/152
584449 5/1979 U.S.S.R. ..... 55/152

*Primary Examiner*—Kathleen J. Prunner

*Attorney, Agent, or Firm*—Burns, Doane, Swecker & Mathis

[57] ABSTRACT

The invention relates to a discharge electrode (30) produced from metal sheet and intended for use in an electrostatic dust precipitator which in addition to incorporating the discharge electrode also incorporates one or more collector electrodes. A voltage source is provided for supplying energy to the discharge and collector electrodes, so as to create therebetween a high d.c. voltage and an electrostatic field which separates dust from a dust-laden medium flowing through the precipitator, this dust settling primarily on the collector electrode. The discharge electrode comprises an elongated member (30) having distributed therealong a plurality of electrode parts presenting one or more discharge tips (37*a*, 37*b*, 38*a*, 38*b*). The electrode parts extend transversally to the longitudinal axis of the elongated member and project beyond the outer defining surfaces thereof. The elongated member (30) is formed from a folded or like corrugated metal sheet, with the folds (31,32,33,34,35) oriented in the longitudinal direction of the elongated member.

29 Claims, 11 Drawing Figures

DISCHARGE ELECTRODE

TECHNICAL FIELD

The present invention relates to a discharge electrode, and in particular to a discharge electrode intended for electrostatic dust precipitators. In addition to discharge electrode, the electrostatic dust precipitator also incorporates collector electrodes arranged in juxtaposed relationship. The precipitator also incorporates a voltage source from which energy is supplied to the two electrodes, so as to create an electric field therebetween.

The high d.c. voltage occurring between the electrodes causes dust present in a dust-laden medium flowing therebetween to separate from said medium and settle primarily on the collector electrodes.

The present invention relates in particular to that kind of discharge electrode which comprises an elongated member having formed therealong electrode parts which present one or more discharge electrode tips.

The discharge electrode can be produced by punching or clipping the same from sheet material and subsequent bending to the shape required.

BACKGROUND PRIOR ART

Various kinds of discharge electrodes are known to the art, and can normally be classified under two separate groups.

The discharge electrodes of the first category or group comprise rods or thin metal strips attached to a frame structure, to which the voltage source is connected. The rods are arranged parallel with one another and are mounted between mutually opposite parts of the frame structure, these rods normally extending in a helical configuration or having the form of weight-loaded straight rods.

Also known to the art are discharge electrodes which are punched from thin sheet-metal material to form therein pointed parts which are each bent to a respective one side of the centre line of the electrode, so as to form electrode parts and electrode tips.

Similarly to the aforedescribed rods, these constructions are not self-supporting, but are secured in a frame structure.

It is necessary with this group of electrodes to restrict the length of the rod or the plate material, and it is necessary to construct a plurality of such frames one upon the other, in order to obtain a sufficiently high structure.

The upper part of the frame structure is normally held by carrier means.

The other category or group of discharge electrodes are designated "rigid discharge electrodes" and are, in themselves self-supporting. These electrodes comprise an elongated member having attached thereto a plurality of electrode parts which present one or more discharge electrode tips. These electrode parts are distributed along the rod-like member and extend beyond the outer defining surfaces thereof. A rigid or self-supporting discharge electrode of this kind is fastened at the top thereof to a carrier and is guided in its bottom region in a manner such to prevent the electrode from deviating from a predetermined intended position.

The discharge electrode described and illustrated in UK Patent Specification No. 1 100 328 constitutes an example of such prior art discharge electrodes.

Another example of a prior art discharge electrode is illustrated in the German Offenlegungsschrift No. 1 557 148.

In this publication it is shown a discharge electrode intended for use in an electrostatic dust separator which, in addition to the discharge electrode, also incorporates one or more collector electrodes and a voltage source intended for supplyin9 energy to the discharge and collector electrodes so as to create therebetween a high d.c. voltage and an electric field effective to separate dust from a dust-laden medium passing through the precipitator or dust separator. This dust is collecting primarily on the collector electrodes.

In the prior art the shown discharge electrode comprising an elongated member having distributed therealong a plurality spaced apart of electrode parts, which presents one or more discharge tips and which extend transversally to the longitudinal axis of the elongated member.

This elongated member being formed from a folded material or a similarly corrugated metal sheet. The folds are oriented in the longitudinal direction of the elongated member.

Finally it should be mentioned that still other constructions are known in previously printed publications and as an example of such constructions reference is given to the following publications:

U.S. Pat. No. 4,303,418
U.S. Pat. No. 4,115,083
Swedish Patent Specification No. 385 548 and
France Patent Specification No. 2 004 430.

DISCLOSURE OF THE PRESENT INVENTION

Technical Problems

Rigid or partially rigid discharge electrodes incorporating electrode parts and discharge tips formed thereon are used in large number in each electrostatic dust separator, and are normally produced in lengths of five meters or more. Consequently, a particular technical problem in this respect is one of imparting to respective electrodes an external geometry which will enable a plurality of said electrodes to be transported while packed close together, preferably in bundles, from the site of manufacture to the site of installation.

A further technical problem is one of imparting to discharge electrodes, together with associated electrode parts and discharge tips, produced from sheet material a configuration or geometry such that when a plurality of discharge electrodes are arranged close together and positioned horizontally for transportation in bundled form the weight of mutually adjacent electrodes does not rest on the discharge tips of respective electrodes and therewith cause plastic deformation of said tips.

Another qualified technical problem is one of enabling a discharge electrode to be readily produced from a sheet material in a form such that when installed in the electrostatic precipitator the electrode will provide uniform current distribution combined with low ignition voltage for corona discharge, and enable twin rows of dischargetips to be formed.

A further technical problem in this respect is one of producing from sheet-metal material a discharge electrode of such configuration or geometry that in addition to solving the aforesaid technical problems it can be readily attached at its upper end to a holding device in a torsionally rigid manner, without needing to take troublesome measures at the upper end of the discharge electrode.

Another technical problem relating to discharge electrodes produced from sheet-metal material and solving the aforesaid technical problems is one of enabling the upper end of the discharge electrode to be readily attached accurately to a holding device in the absence of angular error, such that respective discharge electrodes in one electrode row are positioned in precise relation with collecting electrodes mounted in the electrostatic precipitator, and with the discharge tips of the discharge electrodes in a given alignment in relation to the collector electrodes.

Another technical problem is one of producing a discharge electrode which when subjected to impact forces for the purpose of removing dust collected on said electrode will effectively distribute said forces to the tips of the electrode.

A further technical problem is one of providing a discharge electrode capable of withstanding impact cleansing-forces in both the horizontal and vertical directions.

In relation hereto a further technical problem is one of providing a discharge electrode dimensioned with simple means from a bent sheet-metal material, in which horizontal and vertical forces imparted to the electrode from an impact mechanism will be distributed favourably in the electrode and conveyed to the electrode tips.

In the case of discharge electrodes produced from sheetmetal material, a further technical problem is one of providing a discharge electrode which is flexurily rigid in the flow direction of the dust-laden medium, and of providing a discharge electrode which is flexurily rigid at right angles to the flow direction and horizontally thereto, while still obtaining a discharge electrode with but small flow losses.

Another technical problem is one of providing conditions which will enable a flexurily rigid discharge electrode to be produced from thin sheet-metal material.

It will be understood that another technical problem is one of creating conditions such that when forming a discharge electrode from thin-sheet metal material the material is, on the one hand, located far out from the centre plane of the electrode, so as to create therewith a high degree of flexural rigidity, while, on the other hand, obtaining an electrode geometry which offers but small aerodynamic resistance in the path of the dust-laden medium flowing through the precipitator.

A further technical problem resides in the provision of a discharge electrode where, with simple means, the electrode tips of the electrode can be given any desired configuration and location or with which pre-determined or desirable electric properties can be created in the electrostatic dust precipitator.

Another technical problem is one of readily producing a discharge electrode with which it is readily possible, either in dependence on or independently of one another, to select:

(a) the geometry of the tips of the discharge electrodes;
(b) distribution of the electrode tips in the direction of the longitudinal axis of the electrode and/or;
(c) lateral outward bending of the tips in relation to the centre plane of a discharge electrode.

A further technical problem is one of creating, with the aid of simple means, conditions in which dust which passes (or between) a discharge tip located in a space where the electric field is weak will pass into a space in which a strong electric field prevails when passing the next discharge electrode tip seen in the downstream direction.

Finally, another technical problem resides in the provision of a discharge electrode of sheet-metal material where additional discharge electrode tips can be formed at the time of manufacture with the aid of simple means, and where these electrode tips can be given any desired location.

SOLUTION

The present inention relates to a discharge electrode intended for use in an electrostatic dust precipitator. In addition to incorporating one or more discharge electrodes, the electrostatic precipitator also incorporates one or more collector electrodes, with both electrode types being arranged vertically, and also a voltage source which is intended to supply energy to the two electrodes so as to create therebetween a high d.c. voltage. The electric field created between the electrodes influences dust in a dust-laden medium passing between the electrodes, in a manner to separate dust from the medium, this separated dust settling primarily on the collector electrodes.

The present invention has as its starting point a discharge electrode produced from sheet-metal material and comprising an elongated, self-supporting member having formed in spaced relationship therealong a plurality of electrode parts which extend transversally to the longitudinal axis of the electrode member and which have one or more discharge tips formed thereon.

In accordance with the present invention, the elongated member is formed from corrugated or similarly folded metal sheet, with the folds oriented in the longitudinal direction of the elongated member.

In accordance to the present invention it is suggested that the edge parts of the metal sheet presents electrode parts formed by punching pointed edge flaps in said sheet. The points of the electrode parts face or are bent from one another.

In accordance with a further embodiment of the invention, two corrugations or projections located in the centre part of the electrode are arranged to extend beyond further corrugations or projections located adjacent the firstmentioned projections and formed from said centre part. The two projections positioned in the centre part of the electrode are arranged to extend beyond the centre plane of the electrode to an extent which is equal to, or substantially equal to, the distance through which the electrode parts extend beyond said centre plane.

Preferably, the discharge tips are arranged to extend somewhat beyond the projections. In the case of centrally located projections and further projections, it is proposed that the extension of the projection when seen at right angles to the flow direction of the dust-laden medium shall increase from a centre plane of the discharge electrode and then decrease.

In accordance with one advantageous embodiment of the invention, the projection comprises two mutually converging side parts and a planar part which connects said side parts and which extends parallel with, or substantially parallel with, a centre plane of the electrode.

Preferably, one side part of the projection located in the centre part of the electrode and one side part of the further projection are integrated with one another.

An advantage is afforded when, in accordance with a further development of the invention, a centrally located projection and further projection are arranged to extend beyond the central plane, seen perpendicularly to the flow direction of the dust-laden medium and a central plane of the discharge electrode, so that when seen in the flow direction the projections obtain a progressively increasing width towards the central part of the discharge electrode and thereafter a progressively decreasing width.

One end part, the upper, of the discharge electrode is provided with attachment means in the form of lugs. These attachment means are preferably located on parts of the discharge electrode located in the centre plane thereof. These attachment means may be centrally positioned.

In accordance with a further embodiment of the invention, electrode parts and/or discharge tips oriented along one and/or both edge parts of the metal sheet shall be arranged to alternately face away from a central plane of the electrode. In this respect, electrode parts and/or discharge tips positioned along one edge part of the metal sheet shall be oriented in similarly located pairs and/or off-set in relation to electrode parts and/or discharge tips positioned along the other edge part of the metal sheet. Pairs of similarly located discharge tips preferably face in mutually different directions.

Finally, additional discharge tips are preferably formed on one or more of the aforesaid planar parts connecting the aforesaid side parts and extending parallel with, or substantially parallel with a centre plane of the electrode.

ADVANTAGES

Those advantages primarily afforded by a discharge electrode produced from thin metal sheet in accordance with the present invention reside in the provision of an external electrode geometry which (1) affords good mechanical stability and low electrode weight, (2) affords good current distribution and low ignition voltage, (3) exhibits good aerodynamic properties, (4) can be readily mass produced, and (5) which enables a plurality of such discharge electrodes to be transported and/or stored in bundle form without risk of the discharge tips of mutually adjacent electrodes being plastically deformed as a result thereof. The electrode according to the invention can also be cleansed effectively by means of vertically and horizontally inflicted impact forces.

The primary characterizing features of a discharge electrode according to the present invention are set forth in the characterizing clause of the following Claim 1.

BRIEF DESCRIPTION OF THE DRAWINGS

A preferred embodiment of a discharge electrode according to the invention will now be described in more detail with reference to its use and to the accompanying drawing, in which;

FIG. 3B is an end view and FIG. 3C is a side view of a prior art second embodiment of a narrow discharge electrode produced from thin metal sheet;

DESCRIPTION OF PREFERRED EMBODIMENTS

Figure 1:
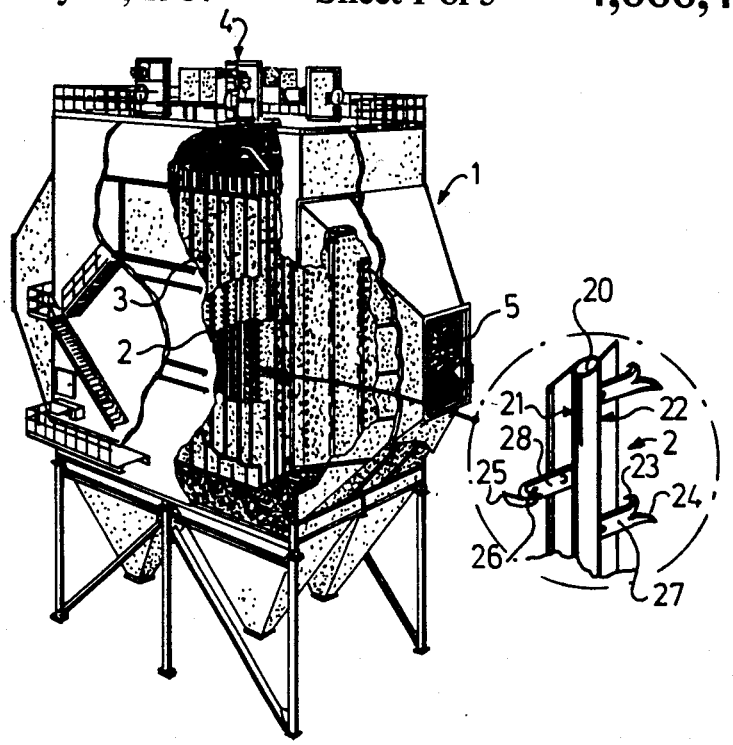
Fig. 1 PRIOR ART
FIG. 1 is a perspective view of a prior art electrostatic dust precipitator, in which previously known narrow, rigid discnarge electrodes are used.

Illustrated in FIG. 1 is an electrostatic dust precipitator 1 which incorporates a plurality of discharge electrodes 2 and a plurality of collector electrodes 3, with the discharge electrodes 2 arranged in a plurality of mutually parallel planes, and the collector electrodes, in turn, also being arranged in a plurality of mutually parallel planes and being positioned between respective discharge electrodes. The illustrated electrostatic precipitator 1 also incorporates a known voltage source (not shown) connected at the location 4 in FIG. 1. The voltage source is intended to supply energy to the discharge and collector electrodes 2 and 3, so as to create therebetween a high d.c. voltage and to generate an electric field.

The electric field created between the electrodes causes dust suspended in a dust-laden medium entering through an inlet 5 and passing between the electrodes to be separated from the medium and settle primarily on the collector electrodes 3. A certain amount of dust, however, will also settle on the discharge electrodes.

The prior art discharge electrode comprises a rod-like member which is flexurily rigid in all directions and which has the form of a tube 20 of round cross-section. As will be seen more readily from the enlarged sectional view of FIG. 1, the tube 20 has distributed along its longitudinal axis electrode parts 27,28 which have formed thereon one or more discharge tips 23,24 and 25,26 and which extend transversally of said longitudinal axis beyond the outer defining surfaces 21,22 of the tubular member 20.

Figure 2A:
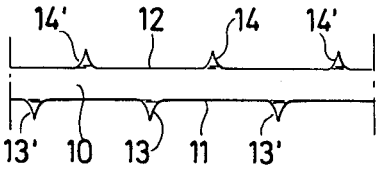
Fig. 2A PRIOR ART
FIG. 2A is a plan view.
Figure 2B:
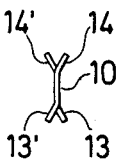
FIG. 2B is an end view of a first prior art embodiment of a discharge electrode produced from thin metal sheet.

FIGS. 2A and 2B illustrate a previously known discharge electrode produced from thin metal sheet. The illustrated discharge electrode comprises an elongated member 10. Distributed along the longitudinal axis of the member 10 are electrode parts which extend transversally to said longitudinal axis. A first plurality of electrode parts 13 are formed from a defining surface 11, whereas a second plurality of electrode parts 14 are formed from an opposite defining surface 12.

The elongated member 10 comprises a thin sheet-metal blank, from which the electrode parts 13,14 are punched and bent. Along one surface 11 there is obtained a plurality of electrode parts 13 bent in one direction, and a plurality of electrode parts 13' bent in the other direction. The same applies to the electrode 14,14' along the other defining surface 12.

Figure 3A:
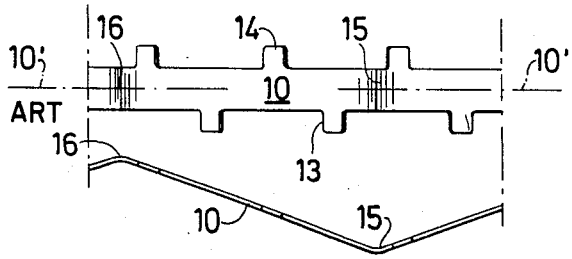
Fig. 3A PRIOR ART
FIG. 3A is a plan view.
Figure 3B:
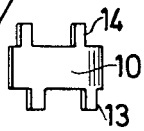

FIGS. 3A, 3B and 3C illustrate a further alternative, in which the electrode formed from a thin sheet-metal blank has been bent at 15 and at 16, perpendicularly to a longitudinally extending central plane 10' of the discharge electrode, in order to take-up thermal stresses.

Figure 4:
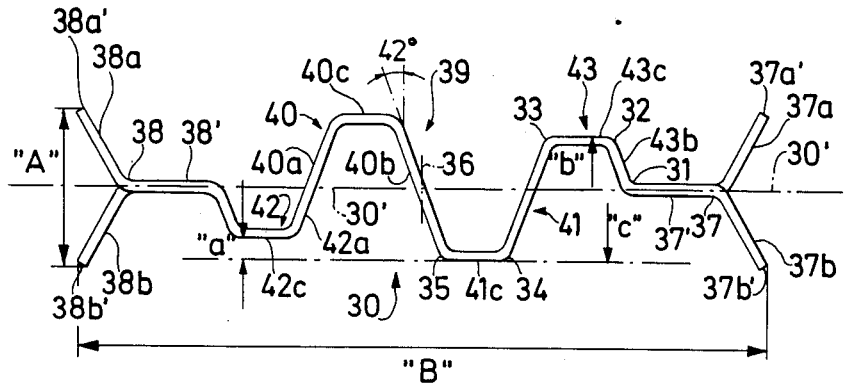
FIG. 4 is an end view of an embodiment of a discharge electrode according to the invention.

FIG. 4 illustrates in end view a discharge electrode 30 constructed in accordance with the invention. This electrode is flexurily rigid in two planes extending at right angles to one another, despite being manufactured from thin metal sheet.

Figure 5:
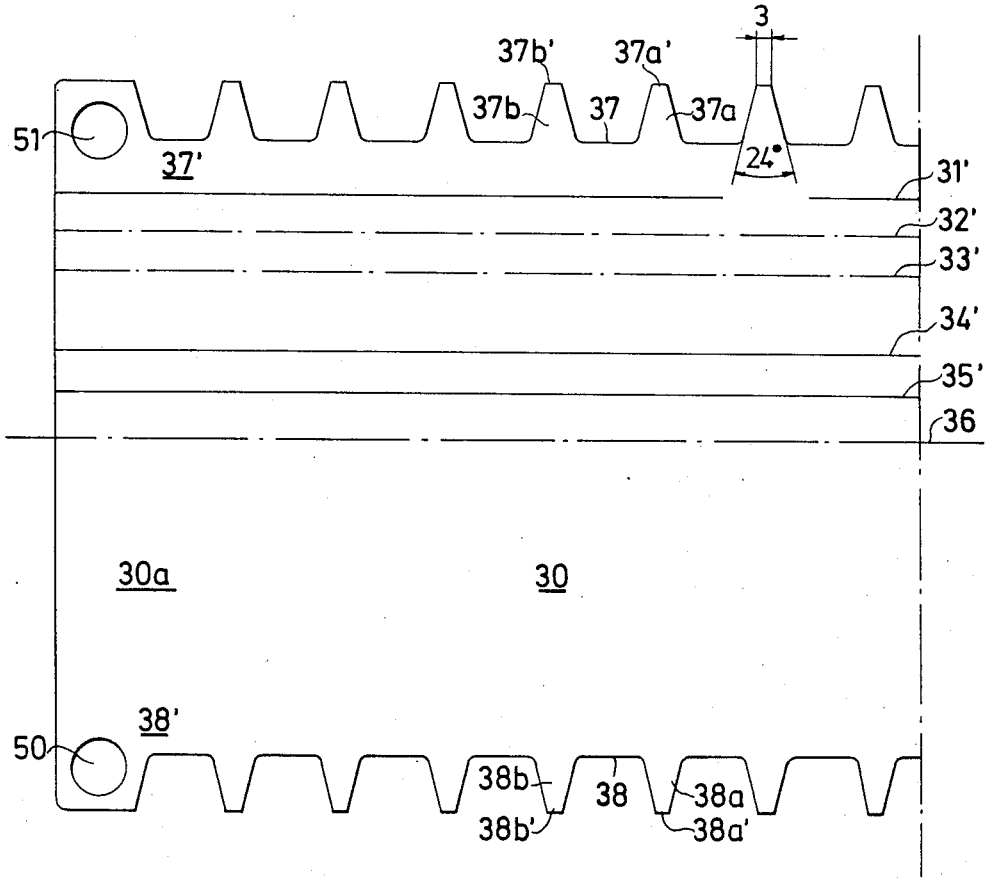
FIG. 5 is a plan view of metal sheet prior to being folded or bent to the form of a discharge electrode according to FIG. 4.

FIG. 5 illustrates in plan view a piece of metal sheet prior to bending or folding the same to form the discharge electrode illustrated in FIG. 4.

The discharge electrode illustrated in FIG. 4 is thus formed from thin metal sheet which is folded or similarly corrugated in a rolling mill or the like, with the folds oriented in the longitudinal direction of the elongated member 30.

In FIG. 5, the fully drawn folding line 31' corresponds to a fold 31 in FIG. 4, a broken folding line 32' corresponds to a fold 32 in FIG. 4, a broken folding line 33' corresponding to a fold 33 in FIG. 4, a fully drawn folding line 34' corresponds to a fold 34 in FIG. 4, and a fully drawn folding line 35' corresponds to a fold 35 in FIG. 4. Fully drawn folding lines indicates a fold from the illustrated plane, while broken lines indicate a fold towards said illustrated plane.

The reference 36 identifies a symmetry line, indicating that folding lines, corresponding to the illustrated folding lines 31'–35', are also oriented on the lower part of the metal sheet shown in FIG. 5.

As will be seen from FIGS. 4 and 5, electrode parts **37*a*, 37*b* are formed along one edge part 37 of the discharge electrode 30, by punching recesses from the metal sheet or forming edge flaps therein, while similar electrode parts 38*a*, 38*b* are formed along a further edge part 38** of the metal sheet, by stamping recesses therefrom or forming edge flaps therein.

The electrode part **37*a* is bent or folded in one direction, and the electrode part 37*b* in the other direction. The electrode part 38*a*** is bent or folded in the other direction.

Two projections 40,41 positioned in the centre part 39 of the electrode part are arranged to extend beyond further projections 42,43 located adjacent the firstmentioned projections 40,41 but further from the centre part 39. This distance has been illustrated by an arrow "a" in FIG. 4.

The distance through which the projections 40,41 extend beyond a centre plane 30' of the electrode is equal to, or substantially equal to, the distance through which the electrode parts **37*a*, 37*b*** extend beyond said centre plane.

The additional projection 43 is arranged to extend beyond the centre plane 30' of the electrode through a distance referenced "b", corresponding to 50–75% of the geometric extension of the projection 41, this geometric extension being referenced "c".

Each projection presents two converging side parts, referenced **40*a* and 40*b* in respect of the projection 40, and a planar part 40*c* which connects the side parts 40*a*,40*b* and which extends parallel to or substantially parallel to the centre plane 30'** of the electrode.

The angle at which the side parts **40*a* and 40*b*** converge lies within the range of 20°–80+, preferably between 30° and 60°, suitably between 40° and 50°.

In the case of the projections positioned in the centre part of the electrode the planar part **40*c* has a length corresponding to half the length of the side parts 40*a*,40*b*. In the case of the further projection 43 of the electrode, the length of the planar part 43*c* corresponds to the length of the side part 43*b***.

In the FIG. 4 embodiment, the one side part **40*a* of the centrally positioned projection 40 and the one side part 42*a* of the further projection 42** are integrated with one another.

In accordance with the present invention, the width "B" of the electrode in relation to the distance "A" between the parts **40*c* and 41*c*, which are located furthest from the central plane 30'** of the electrode, is from 2 to 8 mm and preferably between 3 and 5 mm.

The angle defined by mutually adjacent electrode parts **38*a* and 38*b*** is suitably less than 160° but preferably greater than 30°. Practical experience, coupled with suitable manufacturing methods, have shown that an angle of about 120° is to be preferred.

The electrode parts **37*a* and 37*b* and/or the discharge tips 37*a'* and 37*b'* located along one edge part 37 of the metal sheet are oriented so as to alternately face away from a centre plane 30'** of the electrode.

The electrode parts **38*a* and 38*b* and/or the discharge tips 37*a'* and 38*b'* located along one edge part 38 of the metal sheet are oriented so as to alternately face away from a central plane 30'** of the electrode.

Preferably, electrode parts **37*a* and/or discharge tips 37*a'* positioned along one edge part 37 of the metal sheet are oriented in similarly located pairs with electrode parts 38*a* and/or discharge parts 38*a'* oriented along the other edge part 38** of the metal sheet. The similarly located pairs of electrode parts and/or discharge tips are oriented so as to face in different directions.

In accordance with one advantageous embodiment of the invention, electrode parts **37*a* and/or discharge tips 37*a'* oriented along one edge part 37 of the metal sheet may be slightly off-set pairwise in relation to electrode parts 38*a* and/or discharge tips 38*a'* oriented along the other edge part 38** of the metal sheet.

Although the illustrated embodiment is solely concerned with discharge tips oriented at the edge portions 37 and 38 of the metal sheet, it will be understood that additional discharge tips may be formed on one or more of the planar parts **40*c* and 41*c*. Further discharge tips can also be formed on the planar parts 42*c* and 43*c***.

An advantage is afforded when these further discharge tips are formed by punching from the metal sheet two slots subtending an acute angle therebetween, and by bending out the metal located between the slots. The edge part of this sheet-metal material advantageously faces towards and away from the flow of dust-laden medium.

These further discharge tips are conveniently displaced laterally in relation to the discharge tips formed in the edge parts 37 and 38.

Figure 6:
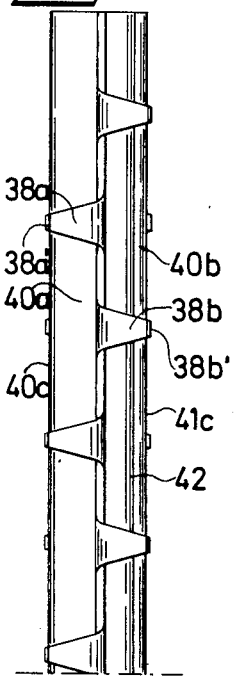
FIG. 6 is a side view of the discharge electrode according to FIG. 4.

FIG. 6 is a side view of the transmission electrode illustrated in FIG. 4, and illustrates that the tips **38*a'*, 38*b'* of the electrodes 38*a*, 38*b* can, to advantage, be extended slightly beyond the surfaces 40*c*. 41*c*. The tips 38*a'*, 38*b'*** may extend to a distance of up to about 7 mm, preferably between one and five mm.

Thus, the present invention enables a discharge electrode which is flexurily rigid in two mutually perpendicular planes to be formed from thin metal sheet.

In addition, the invention enables the provision of a discharge electrode formed from thin metal sheet in which the sheet material is, on the one hand, located far out from a central plane of the discharge electrode, therewith to provide a high degree of flexural rigidity, while, on the other hand, providing a geometry or form which offers but small aerodynamic resistance to the flow of dust-laden medium. In accordance with the invention, a centrally located projection and a further projection are arranged to extend at right angles to the flow direction of the medium and a central plane of the discharge electrode, through a distance beyond said central plane such that when seen in the flow direction the projection obtains a progressively increasing width towards the central part of the electrode, and thereafter decreases progressively in width.

The one end part 30*a*, the upper end part, of the discharge electrode has provided thereon attachment means 50,51 in the form of attachment openings. These attachment means 50,51 are preferably formed in parts 37',38' of the electrode located in the central plane 30' thereof. One such attachment means, not shown, may also be formed in the centre part, particularly when the centre part 39 comprises a planar part.

The discharge tips 38*a'* and 38*b'* are formed on electrode parts 38*a*, 38*b* departing from a part 37', 38' located in the central plane 30' of the discharge electrode.

Figure 7:
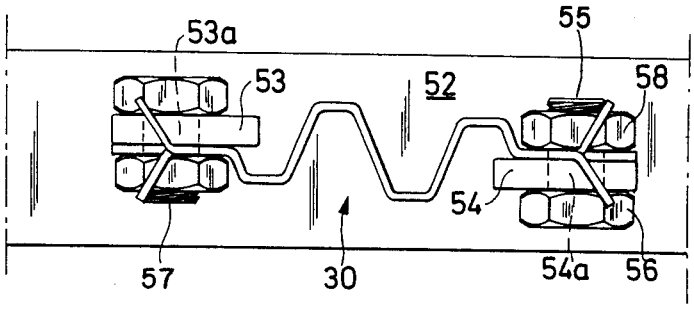
FIG. 7 is an end view of the discharge electrode, illustrating the electrode attached to a bar or rail.

FIG. 7 is an end view of the discharge electrode taken from beneath, and shows means for attaching the electrode to a rail.

The rail 52 has welded thereto two attachment lugs 53 and 54, each of which has a through-passing hole 53*a* and 54*a*.

The upper part 30*a* of the electrode 30 is provided with holes 50 and 51.

Co-acting pairs of holes 53*a*,50 and 54*a*,51 respectively are intended to receive respective bolts 55 and 57, which co-act with nuts 56,58 and 56*a* and 58*a*, respectively when fastening the electrode 30 to the rail 52.

Figure 8:
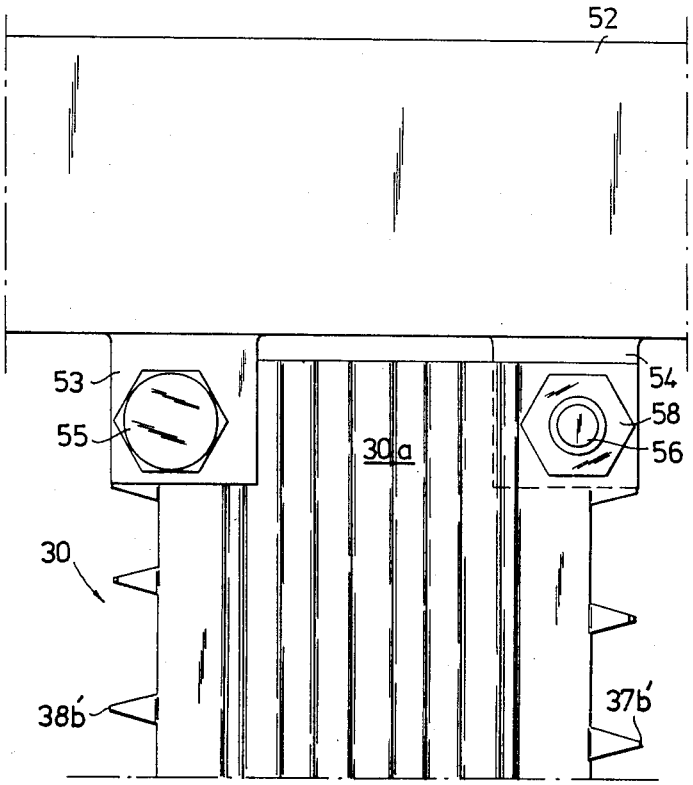
FIG. 8 is a plan view of the discharge electrode connected to a rail.

FIG. 8 is a plan view of the electrode 30 attached to the rail 52.

The invention is not restricted to the aforedescribed embodiment, and modifications can be made within the scope of the following claims.

I claim:

1. A discharge electrode for use in an electrostatic dust separator which, in addition to the discharge electrode, also includes one or more collector electrodes and a voltage source for supplying energy to the discharge and collector electrodes so as to create therebetween a high d.c. voltage and an electric field effective to separate dust from a dust-laden medium passing between the electrodes, the dust falling primarily on the collector electrodes, said discharge electrode comprising an elongated member having distributed therealong a plurality of discharge tips which extend transversally to the longitudinal axis of the elongated member, said elongated member formed form a folded or similarly corrugated metal sheet so as to define projections oriented in the longitudinal direction of the elongated member, wherein an edge part of the metal sheet is provided with said discharge tips by punching pointed edge flaps in said sheet; the pointed edge flaps of the electrode tips being directed away from one another and outwardly beyond a central plane of the electrode; and two of the projections being located in a centre part of the electrode to extend beyond further projections located adjacent said two of the projections at a greater distance from the centre part, each of said projections having mutually converging side parts and a planar part connecting said side parts, the planar part extending substantially parallel to the central plane of the electrode.

2. A discharge electrode according to claim 1, wherein the two projections are arranged to extend beyond the central plane of the electrode through a distance substantially equal to the distance extended by the discharge tips beyond said central plane.

3. A discharge electrode according to claim 2, wherein said further projections extend beyond the central plane of the electrode through a distance corresponding to 50–75% of the extension of said two projections.

4. A discharge electrode according to claim 3, wherein said two projections and said further projections are arranged to extend at right angles to said central plane of the discharge electrode.

5. A discharge electrode according to claim 4, wherein the discharge tips oriented along said edge part of the metal sheet are arranged to alternately face away from the central plane of the electrode.

6. A discharge electrode according to claim 3, wherein the discharge tips oriented along said edge part of the metal sheet are arranged in similarly located pairs with discharge tips oriented along an opposite edge part of the metal sheet.

7. A discharge electrode according to claim 3, wherein the discharge tips oriented along said edge part of the metal sheet are off-set pairwise with discharge tips oriented along an opposite edge part of the metal sheet.

8. A discharge electrode according to claim 3, wherein further discharge tips are formed on the planar part connecting said side parts of the projections.

9. A discharge electrode according to claim 2, wherein the discharge tips are arranged to extend beyond the central plane through a distance less than seven mm.

10. A discharge electrode according to claim 1, wherein the discharge tips are arranged to extend beyond the central plane through a distance less than seven mm.

11. A discharge electrode according to claim 1, wherein the planar part of said projections positioned in the centre part of the electrode has a length corresponding to half the length of one of the side parts projections.

12. A discharge electrode according to claim 11, wherein a length of the planar part of said further projections corresponds to a length of one of the side parts of said further projections.

13. A discharge electrode according to claim 11, wherein one of the side parts of one of the projections located in said centre part and one of the side parts of one of the further projections are integrated with one another.

14. A discharge electrode according to claim 11, wherein further discharge tips are formed on the planar part connecting said side parts of the projections.

15. A discharge electrode according to claim 1, wherein a length of the planar part of said further projections corresponds to a length of one of the side parts of said further projections.

16. A discharge electrode according to claim 15, wherein one of the side parts of one of the projections located in said centre part and one of the side parts of one of the further projections are integrated with one another.

17. A discharge electrode according to claim 15, wherein further discharge tips are formed on the planar part connecting said side parts of the projections.

18. A discharge electrode according to claim 1, wherein one of the side parts of one of the projections located in said centre part and one of the side parts of one of the further projections are integrated with one another.

19. A discharge electrode according to claim 1, wherein the width to distance ratio of the discharge electrode between said planar parts of said two projections is within the range of two to eight.

20. A discharge electrode according to claim 1, wherein attachment means are provided on the electrode.

21. A discharge electrode according to claim 20, wherein the attachment means are located in said central plane of the discharge electrode.

22. A discharge electrode according to claim 21, wherein the attachment means are centrally located on the electrode.

23. A discharge electrode according to claim 21, wherein the discharge tips oriented along said edge part of the metal sheet are arranged to alternately face away from the central plane of the electrode.

24. A discharge electrode according to claim 20 wherein the attachment means are centrally located on the electrode.

25. A discharge electrode according to claim 1, wherein the discharge tips oriented along said edge part of the metal sheet are arranged to alternately face away from the central plane of the electrode.

26. A discharge electrode according to claim 1 wherein the discharge tips oriented along said edge part of the metal sheet are arranged in similarly located pairs with discharge tips oriented along an opposite edge part of the metal sheet.

27. A discharge electrode according to claim 26, wherein each similarly located pairs of said discharge tips face in different directions.

28. A discharge electrode according to claim 1 wherein the discharge tips oriented along said edge part of the metal sheet are off-set pairwise with discharge tips oriented along an opposite edge part of the metal sheet.

29. A discharge electrode according to claim 1, wherein further discharge tips are formed on the planar connecting said side parts of the projections.

* * * * *